US009061515B2

(12) United States Patent
Cameno et al.

(10) Patent No.: US 9,061,515 B2
(45) Date of Patent: Jun. 23, 2015

(54) FLUID SUPPLY SYSTEMS, METHODS, AND ARTICLES OF MANUFACTURE

(75) Inventors: Alfonso Cameno, Barcelona (ES); Francesc Ros Cerro, Barcelona (ES); Arturo Garcia Gomez, Barcelona (ES); Marcos Arminana Terrasa, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/009,770

(22) PCT Filed: Apr. 4, 2011

(86) PCT No.: PCT/US2011/031108
§ 371 (c)(1),
(2), (4) Date: Oct. 3, 2013

(87) PCT Pub. No.: WO2012/138323
PCT Pub. Date: Oct. 11, 2012

(65) Prior Publication Data
US 2014/0022318 A1 Jan. 23, 2014

(51) Int. Cl.
*B41J 2/175* (2006.01)

(52) U.S. Cl.
CPC ..... *B41J 2/17596* (2013.01); *B41J 2/17546* (2013.01); *B41J 2/17556* (2013.01)

(58) Field of Classification Search
USPC ..... 347/84, 86
See application file for complete search history.

(56) References Cited

U.S. PATENT DOCUMENTS

| | | | | |
|---|---|---|---|---|
| 5,724,081 | A | 3/1998 | Maechler et al. | |
| 6,206,511 | B1 | 3/2001 | Cook et al. | |
| 7,533,974 | B2 | 5/2009 | Ohnishi et al. | |
| 2003/0206210 | A1 | 11/2003 | Nakamura | |
| 2004/0183876 | A1 * | 9/2004 | Mizuno et al. | 347/92 |
| 2004/0196326 | A1 | 10/2004 | Sasa | |
| 2005/0035985 | A1 * | 2/2005 | Taguchi et al. | 347/7 |
| 2006/0061639 | A1 | 3/2006 | Yoshino et al. | |

(Continued)

FOREIGN PATENT DOCUMENTS

| | | |
|---|---|---|
| CN | 1326404 | 12/2001 |
| CN | 100376403 | 3/2008 |

(Continued)

OTHER PUBLICATIONS

International Search Report and Written Opinion, issued by the Korean Intellectual Property Office in connection with International Patent Application No. PCT/US2011/031108, on Dec. 20, 2011, 14 pages.

(Continued)

*Primary Examiner* — Stephen Meier
*Assistant Examiner* — Alexander D Shenderov
(74) *Attorney, Agent, or Firm* — Hanley Flight & Zimmerman, LLC

(57) ABSTRACT

Example fluid supply systems, methods and articles of manufacture are disclosed. A disclosed example fluid supply supply system includes a first receptacle to receive a first fluid supply cartridge, a second receptacle to receive a second fluid supply cartridge, and a selection valve to selectively couple a source of pressurized air to the first and second receptacles to provide a fluid to a printhead, only one of the first and second receptacles being coupled to the source of pressurized air at a time.

18 Claims, 4 Drawing Sheets

(56) References Cited

U.S. PATENT DOCUMENTS

| | | | |
|---|---|---|---|
| 2006/0268076 | A1 | 11/2006 | Kaga |
| 2007/0076063 | A1 | 4/2007 | Ohnishi et al. |
| 2009/0262150 | A1 | 10/2009 | Morita |
| 2009/0315927 | A1 | 12/2009 | Uehara |
| 2010/0259575 | A1 | 10/2010 | Uptergrove |

FOREIGN PATENT DOCUMENTS

| | | | |
|---|---|---|---|
| CN | 101203386 | | 4/2008 |
| CN | 101500811 | | 8/2009 |
| CN | 101568438 | | 10/2009 |
| CN | 101676110 | | 3/2010 |
| CN | 201592560 | | 9/2010 |
| JP | S6448916 | | 2/1989 |
| JP | H06967 | | 1/1994 |
| JP | 201270133 | | 10/2001 |
| JP | 2001270133 | | 10/2001 |
| JP | 2001277536 | | 10/2001 |
| JP | 2004314418 | A | 11/2004 |
| JP | 2005193645 | A | 7/2005 |
| JP | 2007015251 | A | 1/2007 |
| JP | 2007118539 | | 5/2007 |
| JP | 2007118540 | A | 5/2007 |
| JP | 2008524042 | A | 7/2008 |
| JP | 2009166358 | A | 7/2009 |
| JP | 2010058339 | | 3/2010 |

OTHER PUBLICATIONS

Japanese Office action, issued in connection with Japanese patent application No. 2014-524042, Aug. 26, 2014, (English translation of list of references cited), 3 pages.

* cited by examiner

FLUID SUPPLY SYSTEMS, METHODS, AND ARTICLES OF MANUFACTURE

BACKGROUND

Some devices such as printers use a pressurized air source generated by, for example, an air pumping device to pressurize cartridges to cause a fluid (e.g., an ink) to flow from the cartridge to, for example, a printhead. Additionally or alternatively, some devices employ two cartridges of the same fluid type (e.g., same ink color) to enable replacement of a cartridge without having to interrupt or pause an operation such as printing.

DETAILED DESCRIPTION

Figure 1:
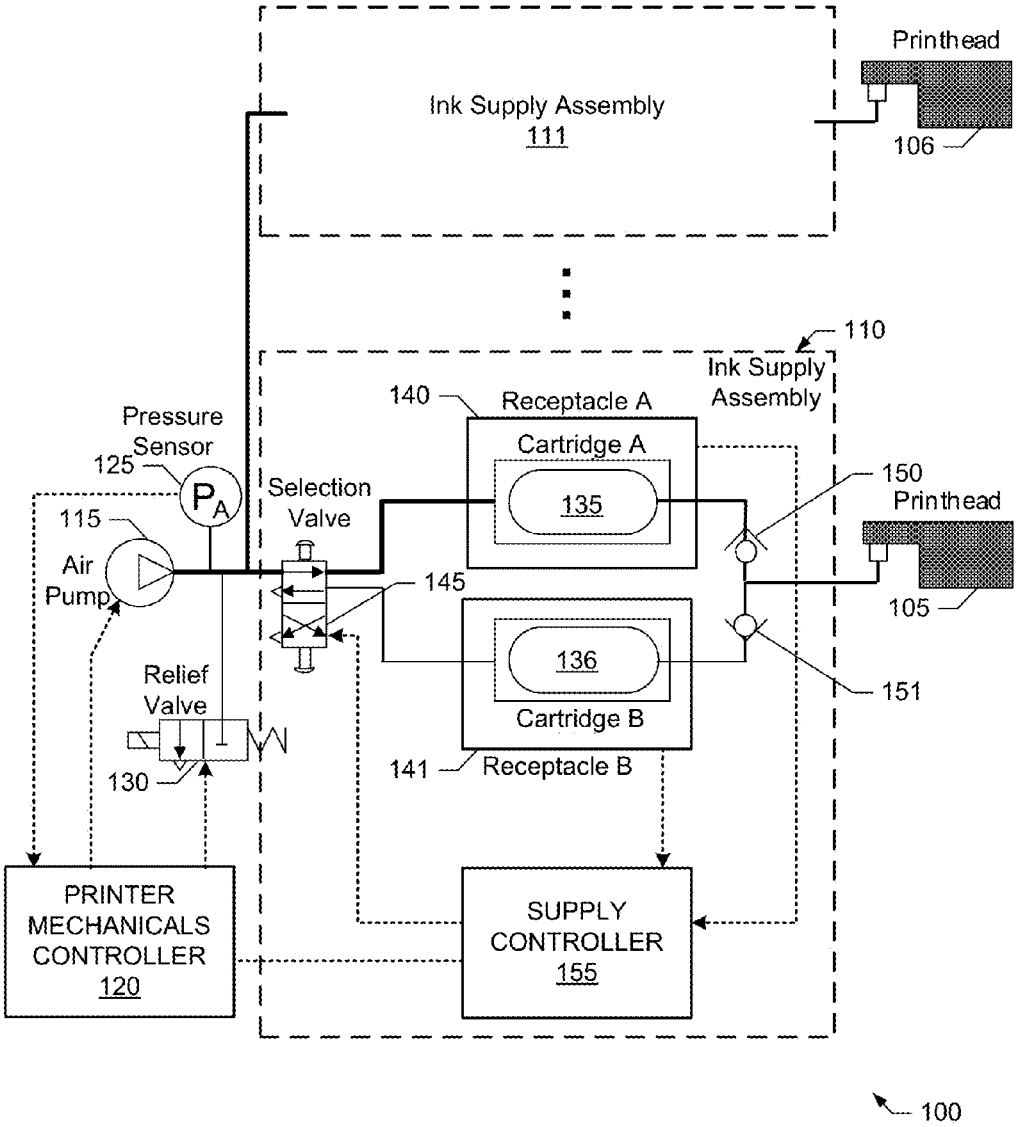
FIG. 1 is a schematic illustration of an example ink supply system structured in accordance with the teachings of this disclosure.

Traditionally, different cartridges in a device such as a printer or fluid administration device have their own pressurized air source. For example, a traditional printer supporting two ink cartridges requires two different pressurized air sources such as two different air pumps. However, such duplication of pressurized air sources increases cost and/or decreases reliability.

Example fluid supply systems, methods and articles of manufacture that overcome at least these problems are disclosed herein. The fluid supply examples disclosed herein include a pressurized air source that is shared by multiple fluid supply cartridges (e.g., ink cartridges) and/or fluid supply assemblies. The pressurized air source is selectively coupled to the cartridges within a fluid supply assembly via a selection valve. By controlling the position of the selection valve, a selected one of the cartridges is fluidly coupled to the pressurized air source and, thus, provides fluid to, for example, a printhead while other cartridges of the fluid supply assembly remain unpressurized and, thus, may be replaced. In some examples, each cartridge has an associated check valve to fluidly couple the associated cartridge to, for example, the printhead and to ensure that a pressurized cartridge does not cause fluid to flow from the pressurized cartridge into an unpressurized cartridge. In disclosed examples, a control module is included to selectively control the selection valve based on detected fluid levels in the cartridges and/or based on which cartridges are currently installed.

A disclosed example fluid supply system includes a first receptacle to receive a first fluid supply cartridge, a second receptacle to receive a second fluid supply cartridge, and a selection valve to selectively couple a source of pressurized air to the first and second receptacles to provide fluid to a printhead, only one of the first and second receptacles being coupled to the source of pressurized air at a time.

A disclosed example ink supply method includes selecting one of a first cartridge or a second cartridge, and controlling a selection valve to selectively connect a source of pressurized air to the one of the first and second cartridges to provide ink to a printhead, only the one of the first and second cartridges being connected to the source of pressurized air at a time.

A disclosed example tangible article of manufacture stores machine-readable instructions that, when executed, cause a machine to at least: select one of a first ink cartridge or a second ink cartridge; and control a selection valve to selectively connect a source of pressurized air to the one of the first and second ink cartridges to provide ink to a printhead only the one of the first and second ink cartridges being connected to the source of pressurized air at a time.

While the examples described herein refer, for ease of discussion, to ink supply systems, assemblies, methods and articles of manufacture for a printer, the example disclosed herein may, additionally or alternatively, be used to implement any number and/or type(s) of fluid supply and/or administration system(s), assembly(-ies), method(s) and/or article(s) of manufacture. Moreover, while this disclosure refers to fluids, it will be understood that the examples described herein may be used to supply any number and/or type(s) of fluid(s) and/or liquid(s) such as a non-compressible low-viscosity liquid such as an ink.

FIG. 1 illustrates an example ink supply system 100. To provide ink to any number and/or type(s) of printheads 105, 106, the example ink supply system 100 of FIG. 1 includes one or more substantially identical ink supply assemblies 110, 111 and a source of pressurized air 115. As shown in FIG. 1, the example source of pressurized air 115 is shared by the example ink supply assemblies 110, 111 and the ink cartridges 135, 136 and receptacles 140, 141 within the ink supply assemblies 110, 111. An example source of pressurized air 115 is any type of air pump and/or air pumping system. While a single air pump 115 is shown in FIG. 1, a second air pump (not shown) may be implemented and/or included for backup, redundancy and/or reliability. In the illustrated example of FIG. 1, any such second air pump may also be shared by the ink supply assemblies 110, 111.

In the illustrated example of FIG. 1, each of the ink supply assemblies 110, 111 is associated with a different color of ink. For example, the ink supply assembly 110 could provide a yellow ink and the ink supply assembly 111 could provide a magenta ink. While in the illustrated example of FIG. 1, each of the ink supply assemblies 110, 111 is depicted as having an associated printhead 105, 106, ink supply assemblies 110, 111 and printheads 105, 106 may be associated in other ways depending on the number and/or type(s) of printheads 105, 106 included in a printer. For example, more than one ink supply assembly 110, 111 may be fluidly coupled to a printhead 105, 106, and/or ink supply assemblies 110, 111 may be fluidly coupled to more than one printhead 105, 106.

To enable a printer mechanicals controller 120 to control the example air pump 115, the example ink supply system 100 of FIG. 1 includes any type of pressure sensor 125 and any type of pressure relief valve 130. Using any number and/or type(s) of method(s), logic and/or algorithm(s), the example printer mechanicals controller 120 of FIG. 1 maintains, adjusts and/or controls the pressure of the air generated and/or provided by the example air pump 115 to ensure a consistent and/or adequate flow of ink from the ink supply assemblies 110, 111 to the printheads 105, 106.

When, for example, a printer including the example ink supply system 100 of FIG. 1 is powered off and/or to facilitate maintenance (e.g., cleaning), the example printer mechanics controller 120 can depressurize the ink supply system 100 by activating, for example, a solenoid and/or direct current (DC) motor to open the example pressure relief valve 130.

To hold ink cartridges 135, 136, each of the example ink supply assemblies 110, 111 of FIG. 1 includes any type(s) of slots, carriers, receptacles, holders and/or supply bays 140, 141. The example receptacles 140, 141 of FIG. 1 fluidly couple a respective ink cartridge 135, 136, when installed, to a respective port of a selection valve 145 and to a respective check valve 150, 151. The example supply receptacles 140, 141 also include any number and/or type(s) of connectors and/or conductors (not shown) that electrically and/or communicatively couple the ink cartridges 135, 136 to a supply controller 155 and/or other devices of a printer. For example, the connectors and/or conductors can be used by the example supply controller 155 to obtain ink level information from the example ink cartridges 135, 136 and/or to determine whether and/or which the ink cartridges 135, 136 are currently installed and/or present in the receptacles 140, 141. While the example ink supply assembly 110 of FIG. 1 has two receptacles 140, 141 to receive two ink cartridges 135, 136, an ink supply assembly 110 may be implemented to support other numbers of receptacles 140, 141 and/or ink cartridges 135, 136 (e.g., three). The example air pump 115 and the example selection valve 145 of FIG. 1 are selected based on, for example, flow rate(s), pressure(s), pump curve and/or effective relief area requirements.

Figure 2:
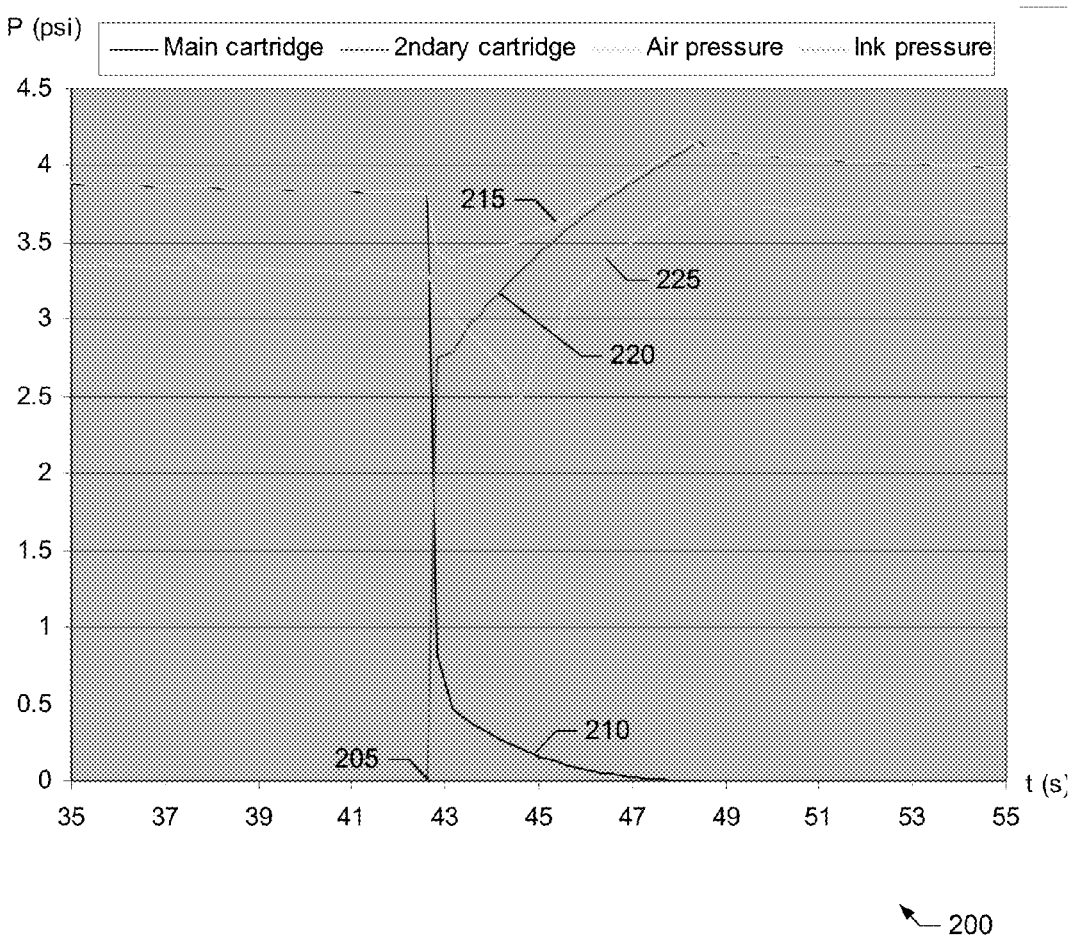
FIG. 2 is a graph illustrating an example operation of the example ink supply assembly of FIG. 1.

As depicted in FIG. 1, the example selection valve 145 is selectively positionable and/or controllable by the example supply controller 155 to selectively couple one the ink cartridges 135, 136 and/or the receptacles 140, 141 to the pressurized air source 115. The example supply controller 155 of FIG. 1 positions and/or controls the selection valve 145 by, for example, activating a solenoid and/or a DC motor. When the example supply controller 155 positions the selection valve 145 in a first position, as shown in FIG. 1, to fluidly couple the ink cartridge 135 to the air pump 115, the ink cartridge 135 becomes pressurized causing ink to flow from the ink cartridge 135 to the printhead 105. In this first position, the ink cartridge 136 is fluidly disconnected from the air pump 115 and, thus, remains depressurized. When the supply controller 155 positions the selection valve 145 in a second position (not shown) to fluidly couple the ink cartridge 136 to the air pump 115, the ink cartridge 136 is pressurized causing ink to flow from the ink cartridge 136 to the printhead 105. In this second position, the ink cartridge 135 is fluidly disconnected from the air pump 115 and, thus, remains depressurized. Accordingly, only one of the ink cartridges 135, 136 is pressurized at a time. Even though, as depicted in FIG. 2, the de-pressurization of one of the cartridges 135, 136 happens while the other cartridge 135, 136 is being pressurized causing the pressure curves of the cartridges 135, 136 to cross at a point of low pressure, such a cross-over does not represent a condition where more than one of the cartridges 135, 136 is pressurized to a pressure sufficient to cause ink to flow. The example selection valve 145 of FIG. 1 is mechanically stable in the first and second positions. As the selection valve 145 is moved from the first to the second position, both of cartridges 135, 136 may momentarily be connected to the air pump 115 causing a momentary increase in system air volume. As such, the cartridge 136 experiences a quick pressure increase to a pressure that can be estimated as percentage (e.g., $(n-1)/n\times 100\%$, where n is the number of ink colors in the printer) of the pressure after the swap. Beyond this point, the rate of pressure growth decreases until the pressure reaches the same pressure as the pressurized air.

To prevent ink from flowing between the ink cartridges 135, 136, the example ink supply assembly 110 of FIG. 1 includes the example check valves 150, 151. When the example selection valve 145 of FIG. 1 is positioned to pressurize a particular ink cartridge 135, 136, its respective check valve 150 will open to allow ink to flow from that ink cartridge 135, 136 to the printhead 105. When the selection valve 145 is positioned to not pressurize a particular ink cartridge 135, 136, its respective check valve 150 will close preventing ink from flowing into that ink cartridge 135, 136, thereby, allowing the ink cartridge 135, 136 to be removed, replaced and/or to prevent the cartridge 135, 136 from being unintentionally filled from another ink cartridge 135, 136. The example check valves 150 also ensure that the cartridge 135, 136 have the greater fluid pressure is the cartridge 135, 136 supplying ink to the printhead 105. The crack pressure of the example check valves 150 and/or the prevention of internal leaks may affect the algorithm(s) used to determine when to switch cartridges 135, 136 and/or operational limits.

As described in more detail below in connection with FIG. 3, the example supply controller 155 of FIG. 1 selects which of its associated ink cartridges 135, 136 is to provide ink to the printhead 105, and positions the selection valve into a corresponding position. The example supply controller 155 selects the installed ink cartridge 135, 136 having the lowest, but not empty, ink level. The example supply controller 155 prevents printing when no ink cartridge 135, 136 is installed and/or when both ink cartridges 135, 136 are empty.

While an example ink supply system 100 has been illustrated in FIG. 1 one or more of the interfaces, controllers, elements and/or devices illustrated in FIG. 1 may be combined, divided, re-arranged, omitted, eliminated and/or implemented in any other way. Further, the example supply controller 155 and/or the example printer mechanicals controller 120 may be implemented by hardware, software, firmware and/or any combination of hardware, software and/or firmware. Thus, for example, the example supply controller 155 and/or the example printer mechanicals controller 120 may be implemented by the example process platform P100 of FIG. 4 and/or one or more circuit(s), programmable processor(s), fuses, application-specific integrated circuit(s) (ASIC(s)), programmable logic device(s) (PLD(s)), field-programmable logic device(s) (FPLD(s)), and/or field-programmable gate array(s) (FPGA(s)), etc. When any apparatus claim of this patent incorporating one or more of these elements is read to cover a purely software and/or firmware implementation, at least one of the example supply controller 155 and/or the example printer mechanicals controller 120 is hereby expressly defined to include a tangible article of manufacture such as a tangible computer-readable medium storing the firmware and/or software. Further still, the example ink supply system 100 may include interfaces, controllers, elements and/or devices instead of, or in addition to, those illustrated in FIG. 1 and/or may include more than one of any or all of the illustrated interfaces, controllers, elements and/or devices.

FIG. 2 is a graph 200 illustrating an example operation of the example ink supply assembly 110 of FIG. 1. Prior to a time 205, the example selection valve 145 of FIG. 1 is in its first position to pressurize the example ink cartridge 135. When the ink bag in the cartridge 135 is substantially full, the air pressure 210 in the ink cartridge 135 is substantially equal to the air pressure 215 generated by the air pump 115. As the ink bag empties, an increasing portion of the air pressure is expended wrinkling the bag. At the time 205, the example supply controller 155 changes the position of the selection valve 145. As shown in FIG. 2, the air pressure 210 in the ink cartridge 135 quickly decreases and air pressure 220 in the ink cartridge 136 quickly increases. During the transition, the pressure 225 of the ink flowing out of the ink supply assembly 110 momentarily decreases and recovers. However, the air pressure 215 is selected and/or controlled by the printer mechanicals controller 120 to ensure that the drop in ink pressure 225 does not interfere with any ongoing print operations.

Figure 3:
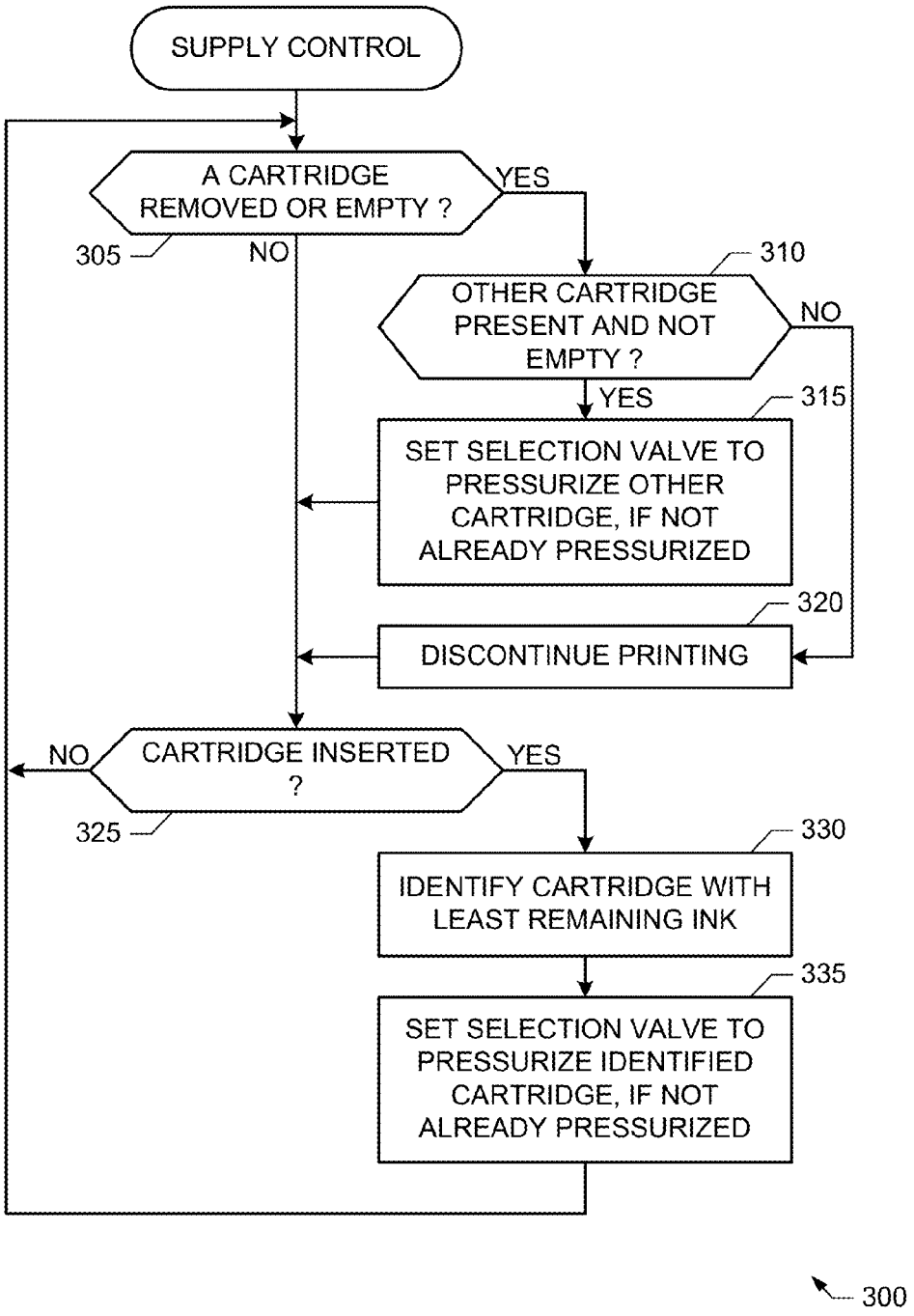
FIG. 3 illustrates an example process that may, for example, be implemented using machine-accessible instructions and executed by one or more processors to control the example ink supply assembly and/or, more generally, the example ink supply system of FIG. 1.

FIG. 3 is a flowchart 300 of an example process that may, for example, be implemented as machine-accessible instructions carried out by one or more processors to implement the example supply controller 155 of FIG. 1. The example machine-accessible instructions of FIG. 3 begin with the supply controller 155 determining whether an ink cartridge 135, 136 has been removed and/or is empty (block 305). If an ink cartridge 135, 136 has been removed and/or is empty (block 305), the supply controller 155 determines whether another non-empty ink cartridge 135, 136 is present (block 310).

If another non-empty ink cartridge 135, 136 is present (block 310), the supply controller 155 controls, sets and/or positions the selection valve 145 to pressurize the non-empty ink cartridge 135, 136, if not already selected (block 315). Control then proceeds to block 325.

If another non-empty ink cartridge 135, 136 is not present (block 310), the supply controller 155 notifies the printer mechanicals controller 120 so that printing is interrupted, paused and/or stopped until a non-empty ink cartridge 135, 136 is installed (block 320). Control then proceeds to block 325.

Returning to block 305, if an ink cartridge 135, 136 has not been removed and/or is not empty (block 305), the supply controller 155 determines whether an ink cartridge 135, 136 has been installed (block 325). If an ink cartridge 135, 136 has been installed (block 325), the supply controller 155 identifies the ink cartridge 135, 136 with the least amount of remaining ink (block 330) and controls, sets and/or positions the selection valve 145 to pressurize the identified ink cartridge 135, 136, if not already selected (block 335). Control then returns to block 305.

Returning to block 325, if an ink cartridge 135, 136 has not been installed (block 325), control returns to block 305.

A processor, a controller and/or any other suitable processing device may be used, configured and/or programmed to execute and/or carry out the example machine-accessible instructions of FIG. 3. For example, the example machine-accessible instructions of FIG. 3 may be embodied in program code and/or instructions stored on a tangible computer-readable medium, and which can be accessed by a processor, a computer and/or other machine having a processor such as the example processor platform P100 of FIG. 4. Machine-readable instructions comprise, for example, instructions that cause a processor, a computer and/or a machine having a processor to perform one or more particular processes. Alternatively, some or all of the example machine-accessible instructions of FIG. 3 may be implemented using any combination(s) of fuses, ASIC(s), PLD(s), FPLD(s), FPGA(s), discrete logic, hardware, firmware, etc. Also, some or all of the example machine-accessible instructions of FIG. 3 may be implemented manually or as any combination of any of the foregoing techniques, for example, any combination of firmware, software, discrete logic and/or hardware. Further, many other methods of implementing the example process of FIG. 3 may be employed. For example, the order of execution may be changed, and/or one or more of the blocks and/or interactions described may be changed, eliminated, sub-divided, or combined. Additionally, any or all of the example machine-accessible instructions of FIG. 3 may be carried out sequentially and/or carried out in parallel by, for example, separate processing threads, processors, devices, discrete logic, circuits, etc.

As used herein, the term "tangible computer-readable medium" is expressly defined to include any type of computer-readable medium and to expressly exclude propagating signals. As used herein, the term "non-transitory computer-readable medium" is expressly defined to include any type of computer-readable medium and to exclude propagating signals. Example tangible and/or non-transitory computer-readable medium include a volatile and/or non-volatile memory, a volatile and/or non-volatile memory device, a compact disc (CD), a digital versatile disc (DVD), a floppy disk, a read-only memory (ROM), a random-access memory (RAM), a programmable ROM (PROM), an electronically-programmable ROM (EPROM), an electronically-erasable PROM (EEPROM), an optical storage disk, an optical storage device, magnetic storage disk, a magnetic storage device, a cache, and/or any other storage media in which information is stored for any duration (e.g., for extended time periods, permanently, brief instances, for temporarily buffering, and/or for caching of the information) and which can be accessed by a processor, a computer and/or other machine having a processor, such as the example processor platform P100 discussed below in connection with FIG. 4.

Figure 4:
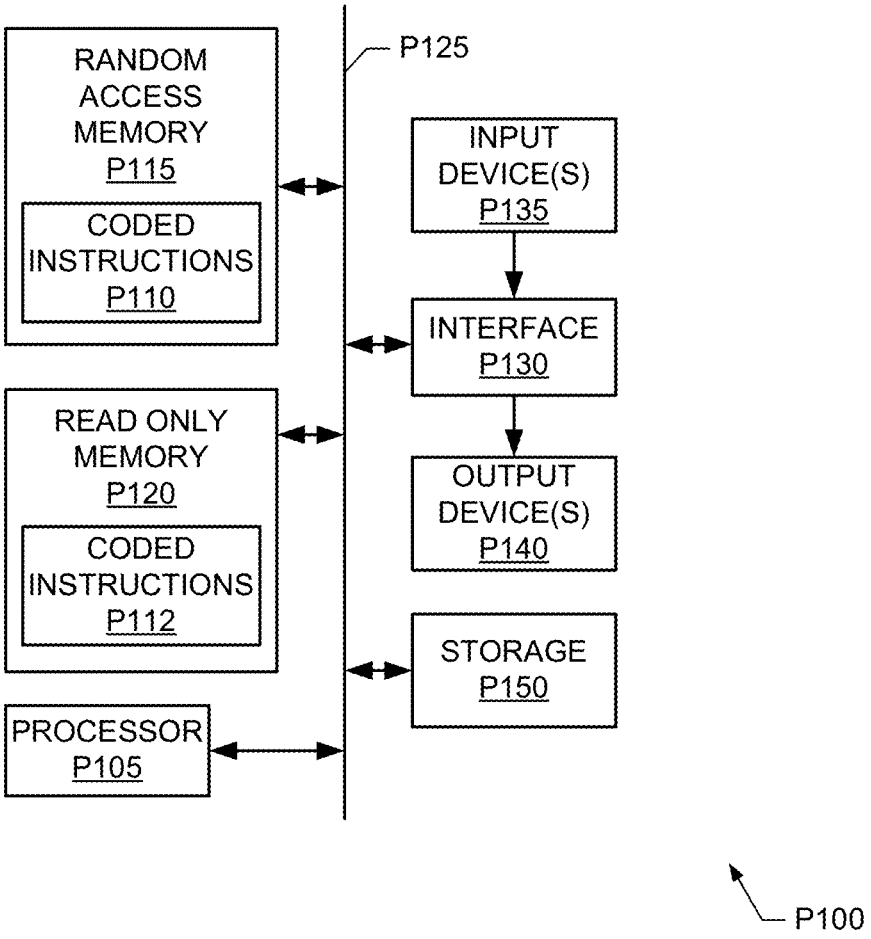
FIG. 4 is a schematic illustration of an example processor platform that may be used and/or programmed to execute the example machine-accessible instructions of FIG. 3 to control the example ink supply assembly and/or, more generally, the example ink supply system of FIG. 1.

FIG. 4 is a block diagram of an example processor platform P100 capable of executing the example instructions of FIG. 3 to control the example ink supply assembly 110 and/or, more generally, the example ink supply system 100 of FIG. 1. The example processor platform P100 can be, for example, any type of computing device containing a processor.

The processor platform P100 of the instant example includes at least one programmable processor P105. For example, the processor P105 can be implemented by one or more Intel®, AMD®, and/or ARM® microprocessors. Of course, other processors from other processor families and/or manufacturers are also appropriate. In general, the processor(s) P105 used depends on implementation specific details such as, but not limited to, support and/or requirements for parallel thread execution and/or the use of ASICs programmed to, for example, manage busses and/or device intercommunication. The processor P105 executes coded instructions P110 and/or P112 present in main memory of the processor P105 (e.g., within a volatile memory P115 and/or a non-volatile memory P120) and/or in a storage device P150. The processor P105 may execute, among other things, the example machine-accessible instructions of FIG. 3 to control the example ink supply assembly 110 and/or, more generally, the example ink supply system 100 of FIG. 1. Thus, the coded instructions P110, P112 may include the example instructions of FIG. 3.

The processor P105 is in communication with the main memory including the non-volatile memory P110 and the volatile memory P115, and the storage device P150 via a bus P125. The volatile memory P115 may be implemented by Synchronous Dynamic Random Access Memory (SDRAM), Dynamic Random Access Memory (DRAM), RAMBUS Dynamic Random Access Memory (RDRAM) and/or any other type of RAM device. The non-volatile memory P110 may be implemented by flash memory and/or any other desired type of memory device. Access to the memory P115 and the memory P120 may be controlled by a memory controller.

The processor platform P100 also includes an interface circuit P130. Any type of interface, such as an external memory interface, serial port, general-purpose input/output, as an Ethernet interface, a universal serial bus (USB), and/or a PCI express interface, etc, may implement the interface circuit P130.

One or more input devices P135 may be connected to the interface circuit P130. The example input devices P135 of FIG. 1 may be used to, for example, receive ink level information and/or ink cartridge installed information from the example ink cartridges 135, 136 and/or the example receptacles 140, 141. One or more output devices P140 are also connected to the interface circuit P130. The output devices P140 may be used to, for example, control the example selection valve 145 and/or to provide print stop information (e.g., both ink cartridges 135, 136 empty) to the printer mechanicals controller 120.

In some examples, the processor platform P100 also includes one or more mass storage devices P150 to store software and/or data. Examples of such storage devices P150 include a FLASH memory device, a floppy disk drive, a hard disk drive, a solid-state hard disk drive, a CD drive, a DVD drive and/or any other solid-state, magnetic and/or optical storage device. The example storage devices P150 may be used to, for example, store the example coded instructions of FIG. 3.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent either literally or under the doctrine of equivalents.

What is claimed is:

1. A fluid supply system comprising:

a first receptacle to receive a first fluid supply cartridge;

a second receptacle to receive a second fluid supply cartridge; and a selection valve comprising first and second ports in fluid communication with the first and second receptacles respectively, the selection valve to selectively couple a source of pressurized air to one of the first or second receptacles to provide a fluid to a printhead, only one of the first and second receptacles being coupled to the source of pressurized air at a time.

2. The fluid supply system as defined in claim 1, further comprising a supply controller to select the one of the first and second receptacles based on fluid levels associated with respective ones of the first and second fluid supply cartridges.

3. The fluid supply system as defined in claim 1, further comprising a supply controller to select the one of the first and second receptacles based on which of the first and second fluid supply cartridges is detected.

4. The fluid supply system as defined in claim 1, further comprising a check valve coupled between the first receptacle and the printhead to fluidly decouple the first receptacle from the printhead when the selection valve is to connect the source of pressurized air to the second receptacle.

5. The fluid supply system as defined in claim 1, further comprising a check valve coupled between the first receptacle and the printhead to fluidly couple the first receptacle to the printhead when the selection valve is to connect the source of pressurized air to the first receptacle.

6. The fluid supply system as defined in claim 1, further comprising:

a third receptacle to receive a third fluid supply cartridge;

a fourth receptacle to receive a fourth fluid supply cartridge; and a second selection valve to selectively couple the source of pressurized air to one of the third or fourth receptacles to provide a second fluid to the printhead, only the one of the third and fourth receptacles being fluidly coupled to the source of pressurized air at a time, wherein the second fluid is different from the fluid.

7. The fluid supply system as defined in claim 1, wherein the source of pressurized air comprises an air pump shared by multiple types of fluid.

8. The fluid supply system as defined in claim 1, further comprising a relief valve to de-pressurize the source of pressurized air.

9. The fluid supply system as defined in claim 1, further comprising a supply controller to:

compare fluid levels of the first and second fluid supply cartridges in response to at least one of the first or second fluid supply cartridges being installed into the corresponding first or second receptacle; and select the one of the first and second receptacles based on the comparison.

10. A fluid supply method comprising:

selecting one of a first cartridge or a second cartridge, the first and second cartridges being in fluid communication with a selection valve; and controlling the selection valve to selectively connect a source of pressurized air to the one of the first or second cartridges to provide a fluid to a printhead, the selection valve to connect only the one of the first or second cartridges to the source of pressurized air at a time.

11. The fluid supply method as defined in claim 10, further comprising:

detecting fluid levels for respective ones of the first and second cartridges; and selecting the one of the first or second cartridges based on the fluid levels.

12. The fluid supply method as defined in claim 11, further comprising selecting the one of the first or second cartridges with a lowest fluid level.

13. The fluid supply method as defined in claim 10, further comprising:

detecting which of the first and second cartridges is present; and selecting the one of the first or second cartridges based on which of the first and second cartridges is detected.

14. The fluid supply method as defined in claim 10, further comprising:

detecting an insertion of at least one of the first or second cartridges into a printer; and comparing fluid levels of the first and second cartridges in response to the detected insertion, wherein the selecting of the one of the first cartridge or the second cartridge is based on the comparison.

15. A tangible article of manufacture comprising machine-readable instructions that, when executed, cause a machine to at least:

select one of a first ink cartridge or a second ink cartridge; and control a selection valve to move between a first position and a second position, the movement of the selection valve to selectively connect a source of pressurized air to the one of the first and second ink cartridges to provide ink to a printhead, the first ink cartridge being connected to the source of pressurized air when the selection valve is in the first position, the second ink cartridge being connected to the source of pressurized air when the selection valve is in the second position, only the one of the first and second ink cartridges being connected to the source of pressurized air at a time.

16. A tangible article of manufacture as defined in claim 15, wherein the machine-readable instructions, when executed, cause the machine to:

detect ink levels for respective ones of the first and second ink cartridges; and select the one of the first and second ink cartridges based on the ink levels.

17. A tangible article of manufacture as defined in claim 15, wherein the machine-readable instructions, when executed, cause the machine to:

detect which of the first and second ink cartridges is present; and select the one of the first and second ink cartridges based which of the first and second ink cartridges is detected.

18. A tangible article of manufacture as defined in claim 15, wherein the machine-readable instructions, when executed, cause the machine to detect ink levels for respective ones of the first and second ink cartridges in response to at least one of the first or second ink cartridges being installed into a printer.

* * * * *